United States Patent [19]

Ehlers

[11] 4,144,437

[45] Mar. 13, 1979

[54] MICROWAVE OVEN ENERGY STIRRER

[75] Inventor: Bruce W. Ehlers, Wayzata, Minn.

[73] Assignee: Litton Systems, Inc., Beverly Hills, Calif.

[21] Appl. No.: 820,106

[22] Filed: Jul. 29, 1977

[51] Int. Cl.[2] ..... H05B 9/06

[52] U.S. Cl. ..... 219/10.55 F; 219/10.55 R

[58] Field of Search ..... 219/10.55 F, 10.55 R, 219/10.55 B, 369; 416/75, 174; 165/87

[56] References Cited

U.S. PATENT DOCUMENTS

| | | | |
|---|---|---|---|
| 3,265,780 | 8/1966 | Long | 219/10.55 F |
| 3,364,332 | 1/1968 | Sven-Olov Reftmark | 219/10.55 F |
| 3,431,381 | 3/1969 | Anderson | 219/10.55 F |
| 3,471,671 | 10/1969 | Puschner | 219/10.55 F |
| 3,505,491 | 4/1970 | Freeland | 219/10.55 F |
| 3,531,950 | 10/1970 | Foerstner | 219/10.55 F X |
| 3,626,136 | 12/1971 | Funahashi | 219/10.55 F |
| 3,692,967 | 9/1972 | Hashimura | 219/10.55 F |
| 3,991,295 | 11/1976 | Akiyoshi | 219/10.55 F |
| 4,019,010 | 4/1977 | Tanaka | 219/10.55 F |
| 4,053,730 | 10/1977 | Baron et al. | 219/10.55 F |

FOREIGN PATENT DOCUMENTS

| | | | |
|---|---|---|---|
| 47232 | 1/1972 | Japan | 219/10.55 F |

*Primary Examiner*—Arthur T. Grimley
*Attorney, Agent, or Firm*—Robert E. Lowe

[57] ABSTRACT

An energy stirrer for a microwave oven is disclosed wherein the stirrer is rotatably mounted in a manner to minimize frictional losses. The stirrer is caused to rotate by the passage of cooling and ventilating air across the blades, the air flow pattern being designed to control the direction and speed of rotation.

5 Claims, 4 Drawing Figures

MICROWAVE OVEN ENERGY STIRRER

BACKGROUND OF THE INVENTION

This invention relates to microwave ovens and specifically with apparatus and methods employed to improve the distribution of energy in the oven.

It is well-known to use a rotatable stirrer in the path of microwave energy to vary energy standing wave patterns and improve energy distribution patterns. Such stirrers may be located in the waveguide, in the cooking cavity, or in a transition zone between the waveguide and the cooking cavity commonly referred to as a feed box.

Stirrers are most frequently motor driven at fairly slow speeds of rotation on the order of 40–65 RPM. Substantially higher speeds of rotation have been found to be less effective in evenly dispersing microwave energy in a cavity than those of the slower speeds indicated.

Several workers in the field have suggested motorless stirrers driven by the passage of air across the blades, the air being derived from that provided for oven component cooling. While air driven stirrers can represent a more economical arrangement than a motor driven stirrer, the air driven variety has been far less widely used because of problems in controlling rotation and arriving at the proper balance between the relative locations of the stirrer and the air source on the one hand and the proper speed of rotation on the other. The more remote the stirrer is located from the cooling air source the greater the requirement to provide a stirrer mechanism having very low rotational friction losses, hence requiring less driving power.

SUMMARY OF THE INVENTION

Many of the problems inherent in prior art designs of energy stirrers are overcome in the present invention in which a unique stirrer mounting arrangement is provided to attain extremely low rotational friction levels. The stirrer is positioned in a feed box outside of the cooking cavity by means of an easily installed mounting bar. The air is directed through the feed box to provide some control of the rotational speed.

DESCRIPTION OF PREFERRED EMBODIMENTS

Figure 1:
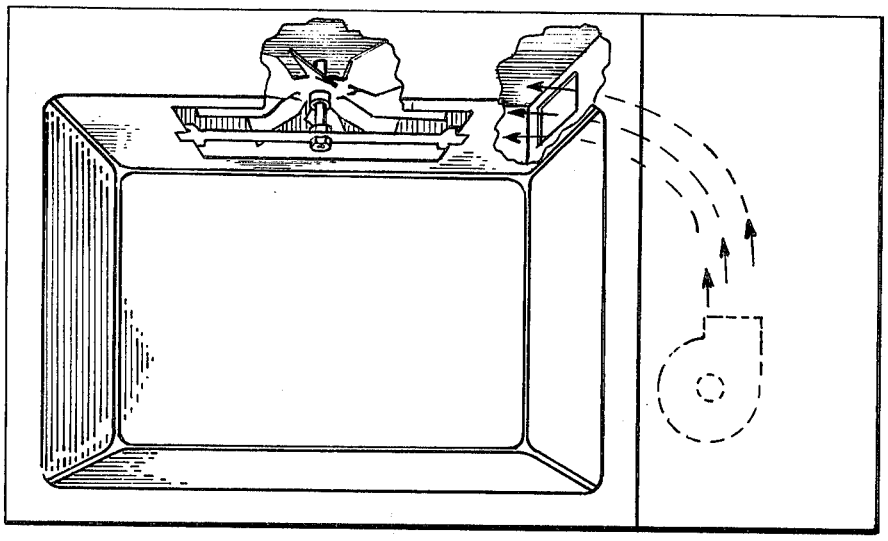
FIG. 1 is a front perspective view of a microwave oven having a portion cut away to illustrate the location of the inventive mechanism.

FIG. 1 depicts a microwave oven 10 including a cooking cavity 11. Microwave energy is transmitted into a feed box 14 at the top of the cavity 11 and from there passes into the cavity. The feed box 14 is equipped with a stirrer 12, at least the blades of which are made from a microwave energy reflective material such as metal. The stirrer 12 is adapted to rotate within the feed box 14 in order to prevent or break up standing wave patterns that would otherwise exist in the oven and hence provide for more even distribution of energy within the cavity 11.

Figure 2:
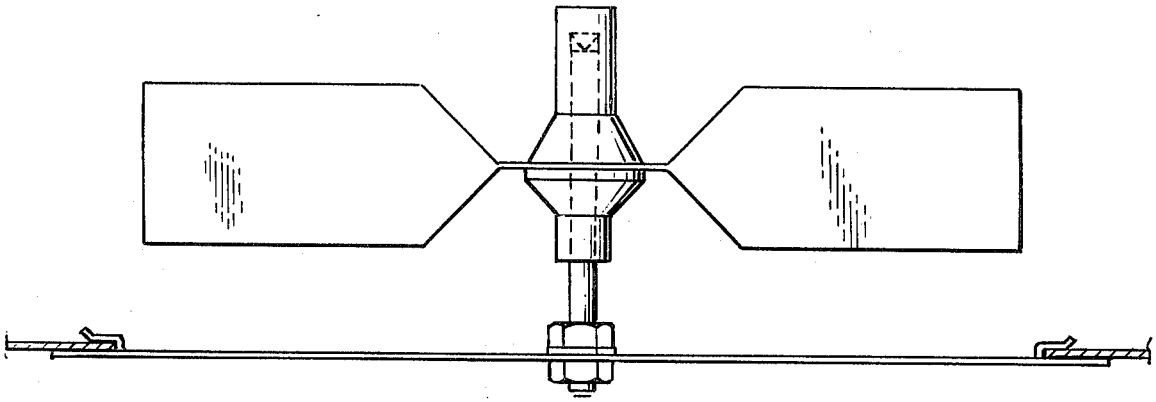
FIG. 2 is an enlarged view of the stirrer mechanism shown in FIG. 1.
Figure 3:
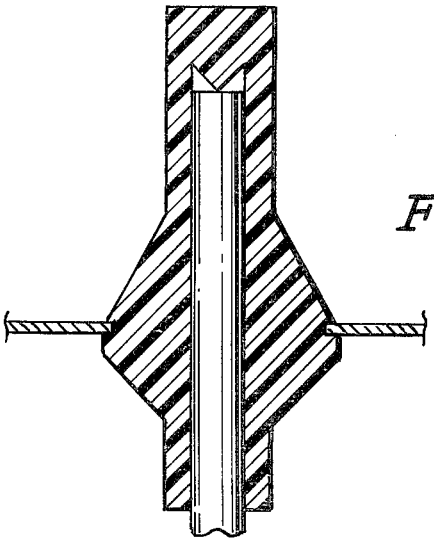
FIG. 3 is a further enlarged view of a portion of the stirrer shown in FIG. 2 partially in cross-section.

The stirrer 12 is supported in the feed box 14 on a mounting bar 13 attached to the surfaces 19 which form the top of the cavity 11 and the bottom of feed box 14. The mounting bar 13 may be attached in a number of different ways including welding or riveting. In the embodiment illustrated in FIG. 2, clips 15 are formed as an integral portion of the ends of the bar and may be attached directly to the edge portions of surfaces 19.

A shaft 29 is mounted in the approximate center of the bar 14 by any suitable means, such as fasteners 22 and 23. The shaft 29 preferably is metal and it is expecially preferred to use chrome plated steel for the shaft because of its relatively smooth finish and resistance to rust.

The blades of the stirrer 12 are attached to hub 16 is preferably made from a non-metal plastic material having high heat resistance characteristics. It is preferred to make the hub from Teflon, a synthetic fluoride resin. Such materials may include polytetrafluoroethylene (TFE) or fluorinated ethylene-propylene (FEP). A particularly preferred substance is an FEP sold under the brand name Teflon 110 by DuPont Chemical Company. A cylindrical bore 24 is formed in the hub sized to receive the shaft 20 in sufficiently loose engagement to allow free rotation but at the same time provide adequate lateral support for the stirrer so it will rotate in a horizontal orientation.

The internal end of the bore 24 has an inverse conical shape shown at 17. The apex of the cone 17 faces the bore so as to engage the top surface 21 of the shaft 20 when the stirrer 12 is in place. In this manner the area of contact between the hub 16 and the shaft 20 is minimized. The combination of minimum area of contact and the inherent lubricious nature of the Teflon material provides a structure having extremely low rotational friction losses.

In the microwave oven illustrated in FIG. 1 the microwave power and control components are located generally on the right side of the oven adjacent the cavity. A fan is provided in the area to draw in outside air and blow it across the electrical components for cooling. The air is then routed or ducted at least in part to the feed box 14 which it enters through perforations 30 formed in one wall of the feed box and exits through similar perforations in the opposite wall.

Figure 4:
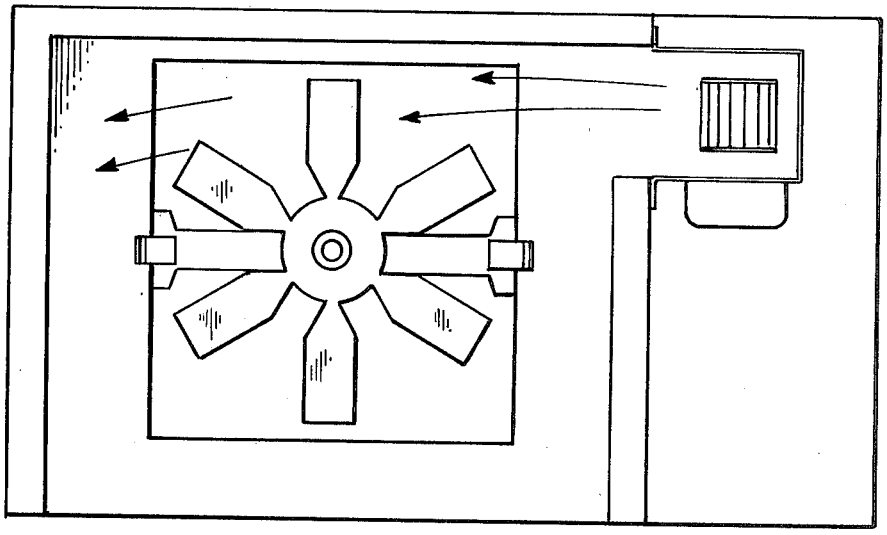
FIG. 4 is a top plan view of the oven of FIG. 1 illustrating the air flow pattern in the vicinity of the stirrer mechanism.

The perforations 30 are positioned so that the air flow, as shown by the arrows in FIG. 4 passes across the tips of the stirrer blades 12 on one side of the axis of rotation and exits the feed box on the same side of the axis of rotation. This insures a preselected rotational direction for the stirrer compatible with the pitch of the stirrer blades, and also provides for an essentially dead air space on the opposite side of the axis of rotation. This dead air space has been found to be of assistance in dampening the rotation of the stirrer 12 to assist in keeping its rate in the range of 20–70 RPM which is desired for optimum energy distribution pattern.

The stirrer mounting arrangement disclosed herein provides the basis for an air driven stirrer system achieving excellent performance results. The conical shape of the bearing surface in the stirrer hub working in conjunction with the hard, smooth surface of the mounting shaft provides an almost frictionless rotational support. It is therefore unnecessary to provide a special fan to power the stirrer, or to alter the cooling air flow of the oven to accomodate the stirrer. Thus the cooling system can be constructed with the normal design considerations and the air stirrer does not add an additional design factor to be solved. Placing the stirrer in a feed box which can in effect operate as a fan should for purposes of the invention allow for optimum control of air flow across the stirrer and ultimately its speed of rotation.

I claim:

1. An energy stirrer for a microwave oven, said stirrer comprising a hub portion having a central bore therein; a plurality of microwave energy reflective blades mounted to said hub portion; a mounting shaft engaging said bore; the interior end of said bore having a conical shape with the apex of the cone facing into said bore and riding on the end of said mounting shaft, whereby said stirrer is rotatable about said shaft.

2. An apparatus for effecting a random microwave energy distribution in a microwave oven comprising a transition zone located between a microwave energy source and a microwave cooking cavity; a shaft positioned vertically in said zone; an energy stirrer having a plurality of blades attached to a hub, said hub including a bore sized to loosely fit said shaft, said bore having a conical projection at its interior end adapted to ride on said shaft; means for passing air through said zone to impinge on at least a portion of said blades to cause said energy stirrer to rotate within said zone.

3. The apparatus of claim 2 wherein said hub is made from a synthetic fluoride resin.

4. The apparatus of claim 3 wherein said resin is fluorinated ethylene-propylene.

5. The apparatus of claim 2 including a bracket mounted transversely of said zone, said shaft being mounted to said bracket.

* * * * *